US007741778B2

(12) United States Patent
Takada et al.

(10) Patent No.: US 7,741,778 B2
(45) Date of Patent: Jun. 22, 2010

(54) PLASMA DISPLAY PANEL AND MANUFACTURING METHOD THEREFOR

(75) Inventors: Yuusuke Takada, Katano (JP); Nobuaki Nagao, Katano (JP); Toru Ando, Osaka (JP); Masaki Nishimura, Takatuki (JP); Ryuichi Murai, Toyonaka (JP); Hidetaka Higashino, Souraku-gun (JP)

(73) Assignee: Panasonic Corporation, Osaka (JP)

( * ) Notice: Subject to any disclaimer, the term of this patent is extended or adjusted under 35 U.S.C. 154(b) by 808 days.

(21) Appl. No.: 11/606,656

(22) Filed: Nov. 30, 2006

(65) Prior Publication Data

US 2007/0075640 A1 Apr. 5, 2007

Related U.S. Application Data

(62) Division of application No. 10/398,296, filed on Apr. 3, 2003, now abandoned.

(51) Int. Cl.
*H01J 17/49* (2006.01)

(52) U.S. Cl. ..... 313/586; 313/582; 313/292

(58) Field of Classification Search ..... 313/582–586, 313/581, 292

See application file for complete search history.

(56) References Cited

U.S. PATENT DOCUMENTS

| | | | | |
|---|---|---|---|---|
| 4,827,186 | A | 5/1989 | Knauer et al. | |
| 5,825,128 | A | 10/1998 | Betsui et al. | |
| 6,249,264 | B1 | 6/2001 | Sano et al. | |
| 6,288,483 | B1 | 9/2001 | Haven | |
| 6,307,318 | B1 | 10/2001 | Kaake et al. | |
| 6,376,986 | B1 * | 4/2002 | Takagi et al. | 313/582 |
| 6,414,435 | B1 | 7/2002 | Akiba | |
| 6,608,441 | B2 * | 8/2003 | Kunii et al. | 313/584 |
| 7,002,296 | B2 * | 2/2006 | Sano et al. | 313/583 |

FOREIGN PATENT DOCUMENTS

| | | |
|---|---|---|
| CN | 1344005 A | 8/2003 |
| EP | 0 920 048 A2 | 6/1999 |
| JP | 4277439 | 10/1992 |
| JP | 5094772 | 4/1993 |
| JP | 07-045191 | 2/1995 |
| JP | 09-050768 | 2/1997 |
| JP | 9190768 | 7/1997 |
| JP | 11-213896 | 8/1999 |
| JP | 2001-110305 | 4/2001 |
| JP | 2001-118492 | 4/2001 |
| JP | 2002-083545 | 3/2002 |
| WO | 00/13198 | 3/1999 |

* cited by examiner

*Primary Examiner*—Karabi Guharay
*Assistant Examiner*—Sheryl Hull

(57) ABSTRACT

The present invention aims to ensure luminosity while improving evacuation characteristics in a plasma display panel. First ribs (112) that separate a plurality of cells from each other and second ribs (113) are formed in stripe patterns so as to intersect with each other on a surface of a first substrate (107), a surface of a second substrate opposes tops of the first ribs, and a height of the ribs at intersections (112*b*) of the first and second ribs intersect is lower than other parts of the first ribs (112*a*).

9 Claims, 9 Drawing Sheets

PLASMA DISPLAY PANEL AND MANUFACTURING METHOD THEREFOR

CROSS-REFERENCE TO RELATED APPLICATIONS

This application is a divisional application of U.S. patent application Ser. No. 10/398,296 filed on Apr. 3, 2003 now abandoned.

TECHNICAL FIELD

The present invention relates to a plasma display panel and a manufacturing method therefor.

BACKGROUND ART

Expectations have heightened in recent years regarding high-quality, large-screen displays, such as high vision displays. These expectations are being answered with progress in research and development in fields relating to CRTs, liquid crystal displays (LCDs), plasma display panels (PDPs) and so on.

CRTs, which are conventionally used widely as displays in televisions, are superior in terms of resolution and picture quality. However, CRTs are not suitable as large-screen displays of 40 inches or more due to the fact that a larger screen size leads to increased depth and weight.

Furthermore, LCDs, while having the advantage of low power consumption and avoiding the problems of depth and weight, have a limited viewing angle. This is something that must be improved if large-screen LCDs are to be manufactured.

In contrast to CRTs and LCDs, it is relatively easy to make large-screen PDPs even with a shallow depth, and 50-inch class PDPs are already on the market.

A structure such as the 3-electrode surface discharge PDP shown in FIG. 3 is common in conventional PDPs.

The PDP in FIG. 7 is composed of a front panel 101 and a back panel 106 that oppose each other, and a plurality of pairs of parallel display electrodes 103 on the inner surface of the front panel 101. A conductive layer 104 that is a 40 μm-thick low-conductive glass covers the display electrodes 103. An 800 nm-thick MgO film is formed on the surface of the conductive layer 104 as a protective layer 105. The MgO film is generally formed using an evaporation method or a sputter method.

A plurality of ribs 112 and address (data) electrodes 108 are provided parallel to each other on the inner surface of the back panel 106. The ribs 112 separate discharge spaces. The spaces surrounded by neighboring ribs 112 and the protective layer 105 are reserved as discharge spaces. Phosphor 111 that corresponds to one of R, G, and B is applied between neighboring ribs 112.

After being arranged facing each other, the edges of the front panel 101 and the back panel 106 are sealed together. After the discharge spaces are evacuated, a discharge gas is inserted into the discharge spaces. The discharge gas is a compound neon gas that includes some volume percentage of xenon.

In a 3-electrode surface discharge PDP 114 composed as described, voltage is applied to the address electrodes 108 and the display electrodes 103 with an appropriate timing, causing discharge in discharge spaces 115 separated by ribs 112 that correspond to display pixels. This discharge causes the xenon gas to generate ultraviolet rays which excite the phosphor, thus causing the phosphor to discharge visible light. This is how images are displayed.

A surface discharge PDP has the above-described simple structure of two panels sealed together.

However, as a perspective view of the back panel in FIG. 8 shows, the ribs 112 in the conventional PDP having the above-described construction are formed in lines. This means that while the PDP has relatively good evacuation characteristics in the evacuation process of the discharge spaces during manufacturing, there is a limit in the surface area to which phosphor can be applied, and the surface area is not sufficient for improving luminosity.

Recently, various shapes of ribs are being experimented with in order to improve this.

For example, in the example of a perspective view of a back panel shown in FIG. 9, the line-shaped ribs 112 and ribs 113 that intersect with the ribs 112 are positioned so as to enclose the discharge space in each cell individually. Here, the height of each rib 113 is lower than the height of neighboring ribs 112. Providing the ribs 113 in this manner attempts to maintain evacuation characteristics of pairs of neighboring ribs 112, while using the surface of the ribs 113 to increase the surface area of the phosphor.

Another example is one where the ribs composed in a honeycomb shape in which each honeycomb-shaped part is formed by line-shaped ribs and two adjoining ribs. This structure aims to maintain evacuation characteristics in the same manner as the rib structure shown in FIG. 8, while improving luminance by actually increasing the size of discharge spaces (IDW '99 Proceeding of The Sixth International Display Workshops).

However, while substantially sufficient luminosity is ensured in the above-described example, there is scope for improving evacuation characteristics. In other words, even using an idea such as the above-described example, evacuation is still not able to be performed quickly and sufficiently in the evacuation process. As a result, residue that should be removed in the evacuation process builds up in the PDP, causing flickering an the like in images and hindering image display.

For this reason it is necessary to solve this problem as soon as possible.

DISCLOSURE OF THE INVENTION

In order the solve the above-described problem, the present invention is a plasma display panel that includes a first substrate that has a plurality of first ribs and second ribs formed on a surface thereof, and a second substrate that opposes the first substrate via the ribs, the first ribs being arranged in a stripe pattern and separating a plurality of cells from each other, and the first ribs and second ribs intersecting with each other, wherein a height of the first ribs and the second ribs at intersections is less than a height of other parts of the first ribs.

By different parts of the first and second ribs having different heights, vents can be provided in the area between the first and second substrates, and evacuation can be performed quickly from both a direction along the first ribs and areas corresponding to the intersections of the first and second ribs. As a result, the time required in the plasma display panel manufacturing process for the evacuation process can be reduced, while almost all residue is removed from inside the panel, and a plasma display panel with superior display performance can be provided.

Note that the height of the second ribs may be substantially the same as the height at the intersections, and the second ribs are wider than the first ribs. This enables the parts of the first and second ribs that have differing heights to be formed favorably, and is therefore preferable.

Furthermore, in the plasma display panel pairs of neighboring first ribs may meander so as to form symmetrical trapezoid-shapes around each cell. This enables the surface area of the parts of the ribs that form the trapezoids to be used as surface area for applying the phosphor, and enables even more efficient improvement in panel luminosity.

Furthermore, in the present invention, protrusions may be formed on the surface of the second substrate that opposes the first substrate, each protrusion corresponding to the height of the intersections and extending orthagonally to the first ribs, and a space may be provided between a top of each protrusion and first and second ribs that oppose the protrusion. By forming protrusions on the surface of the first substrate in this manner, crosstalk between cells can be suppressed. Therefore, a plasma display panel having a fine cell structure and superior display performance can be provided.

Furthermore the present invention is a plasma display panel that includes a first substrate that has ribs formed on a surface thereof so as to separate a plurality of cells from each other in hexagonal honeycomb shapes, and a second substrate whose surface opposes tops of the ribs, wherein the ribs that surround each cell are cut out in at least three places, each place being an area of the ribs that opposes the second substrate, thereby linking discharge spaces that are separated by the ribs. This construction also has substantially the same effect the above-described structure. Furthermore, separating cells by hexagonal honeycomb-type ribs produces a high-definition plasma display panel.

Furthermore, the present invention is a plasma display panel display apparatus, in which a plasma display panel that includes: a plurality of address electrodes on the surface of the first substrate, and a plurality of display electrodes on the surface of the second substrate, the address electrodes and the display electrodes being provided in opposition so as to intersect with each other; and the plasma display panel display apparatus includes: an address electrode driving circuit for driving the address electrodes; a display electrode driving circuit for driving the display electrodes; and a controller for controlling both the circuits. This enables a plasma display panel to be provided that has dramatically improved evacuation characteristics and display performance compared to a conventional plasma display panel.

Here, the above-described plasma display panel may be manufactured according to a method for manufacturing a plasma display panel in which ribs are formed on a surface of a first substrate, and a second substrate is positioned so as to oppose the first substrate via the ribs, wherein a layer that includes glass is formed in advance on the surface of the first plate, and the ribs are formed by using a sandblast method where a blast rate is varied so that a height of the ribs varies in parts.

Furthermore, a possible method is a method for manufacturing a plasma display panel in which ribs are formed on a surface of a first substrate, and a second substrate is positioned so as to oppose the first substrate via the ribs, wherein ribs that include part of the first ribs and the second ribs are formed on the surface of the first substrate using a photoresist method, and the remaining parts of the first ribs are formed on the ribs that include the first ribs using the photoresist method again, the remaining parts of the first ribs having a different height to the second ribs.

In addition, a possible method is a method for manufacturing a plasma display panel in which ribs are formed on a surface of a first substrate, and a second substrate is positioned so as to oppose the first substrate via the ribs, wherein a first rib material and a second rib material are applied to a surface of the first substrate, the second rib material being applied so as to intersect with the first rib material and so as to be wider than the first rib material, and the first plate to which the first and second rib material has been applied is subject to a baking process, and in the baking process, the first ribs are formed to be uneven in height, according to the second rib material being pulled by the first rib material at points where the first and second ribs materials intersect.

The present invention solves the above-described problems of conventional plasma display panels, and improves evacuation characteristics by making use of the thickness direction of the ribs, and also reduces power consumption. Conventionally, ribs usually tightly touch the opposing glass surface so that charged particles from each pixel do not move to neighboring pixels. However, the connecting parts of ribs are not greatly influenced by movement of particles. Furthermore, lowering the height of the connecting parts has been avoided because the connecting parts of the ribs are an important part of the frame of the two sealed substrates. However, by making other parts of the ribs an even height so as to contact the opposing substrate, and making only the connecting parts low, it is not necessary to provide a path for evacuation. As a result, both improvement in luminosity and evacuation characteristics can be achieved.

Furthermore, an object of the present invention is to provide a simple method for forming the ribs by varying the shape of the ribs in manufacturing.

Furthermore, in order to achieve the above-described object, the present invention has discharge gas spaces, two insulated substrates that sandwich the discharge gas spaces, and ribs that separate the discharge gas spaces and separate pixels, the ribs isolating each pixel from neighboring pixels, and each rib being lower in parts that connect with another rib. By providing depressions at the rib connecting parts, a structure can be obtained that is strong in regard to mis-discharge and that reduces conductance during evacuation. Furthermore, this structure is extremely effective not only for rectangular patterns of ribs, but also for polygonal-structured ribs. Here, it is preferable that at least two rib connecting parts of neighboring cells are low.

Furthermore, the present invention is a surface discharge plasma display panel that has discharge gas spaces, two insulated substrates that sandwich the discharge gas spaces, and ribs that separate the discharge gas spaces and separate pixels, a pair of surface discharge electrodes composed of an X electrode and a Y electrode being formed on a front surface of one of the insulated substrates and being covered by a conductive layer, wherein the ribs include ribs A that are formed on the other insulated substrate opposing and intersecting with the surface discharge electrodes, and ribs B that are formed so as to be parallel with the surface discharge electrodes and to be wider than the ribs A, and the parts of the ribs A and the ribs B that connect with each other are lower than other parts. By including both thick parts and narrow parts in the ribs, the depressions in the rib connection parts can be formed relatively easily. Here, it is preferable that the ribs A are lower than the ribs B.

Furthermore, the present invention is a first or a second plasma display panel, a display electrode driving circuit connected to the plurality of pairs of line electrodes for driving the plasma display panel, an address electrode driving circuit connected to address electrodes for selecting pixels in the plasma display panel, and a controller for controlling the display electrode driving circuit and the address electrode driving circuit. By using the plasma display panel of the present invention in a display apparatus, a display apparatus that has low power consumption and high luminosity can be provided.

Furthermore, in order to achieve the above-described object, the present invention is a method for manufacturing the first to the second plasma display panel of the present invention, the method using a sandblast method when performing rib patterning, and forming differences in height of the ribs by taking advantage of blast rate being different for differences in the blasted surface area.

In addition, in order to achieve the above-described object, the present invention is a method for manufacturing ribs of a plasma display panel, the method including: a step of first forming a pattern of first ribs A and ribs B to a height of the ribs B, using photosensitive paste, and a step of then forming the pattern of the ribs A on the formed ribs to a height of the ribs A, using photosensitive paste.

Note that FIGS. 1-6 show examples only, and the present invention is not limited to these examples.

BEST MODE FOR CARRYING OUT THE INVENTION

Structure of the First Embodiment

Figure 1:
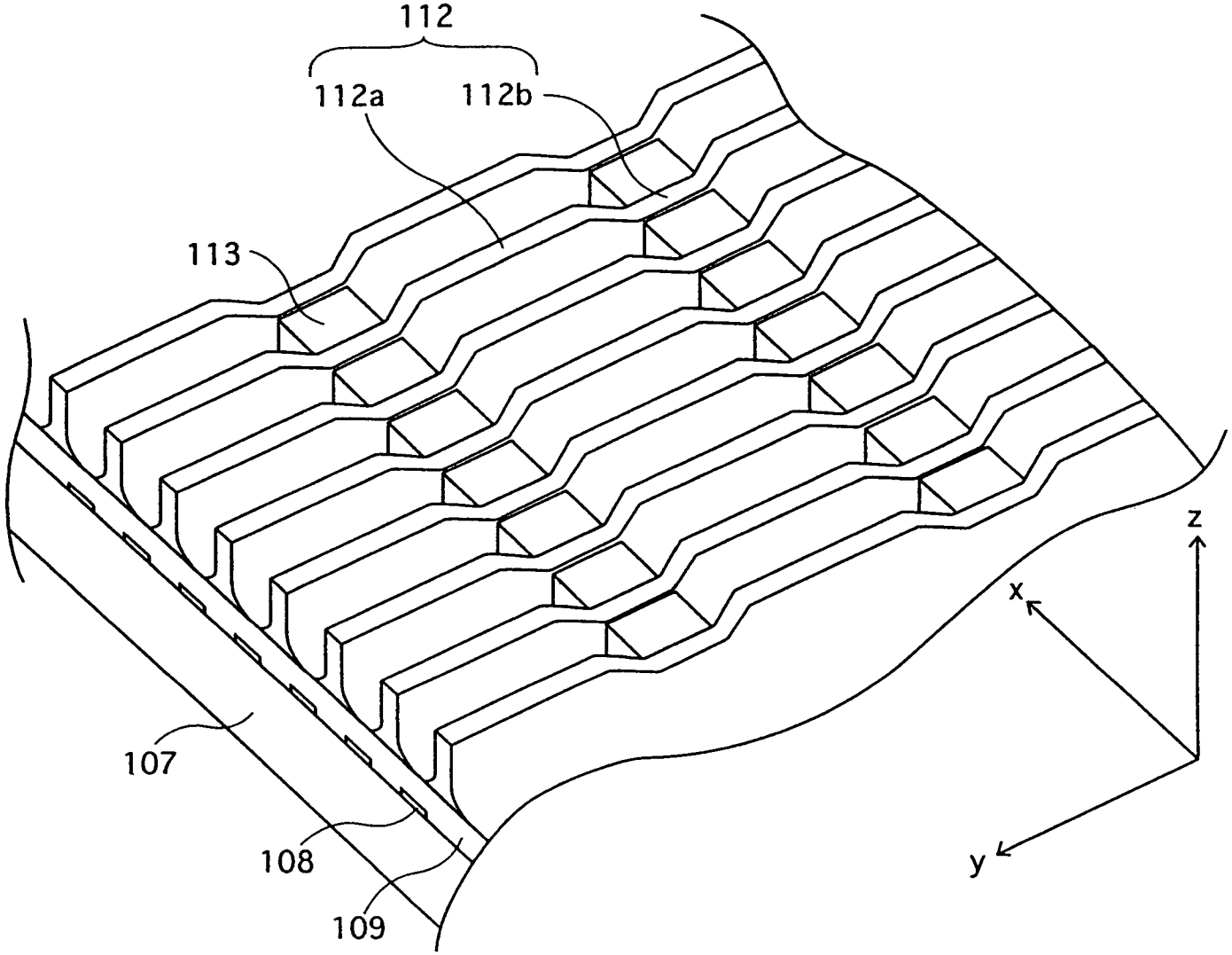
FIG. 1 is a perspective diagram of the back panel of a PDP in a first embodiment.

FIG. 1 is a perspective diagram of the back panel of a PDP in a first embodiment. The main characteristic of the present embodiment is the form of the back panel.

The following describes an example of a PDP whose cells are 360 μm (width in an x direction) by 1080 μm (width in a y direction). By aligning three such cells having respective colors R, G and B, a pixel of 1080 μm (width in the x direction) by 1080 μm (width in the y direction) is formed.

Note that the dimensions used here are simply one example, and the PDP of the present invention is not limited to these dimensions.

As the drawing shows, stripe-shaped ribs 112 that extend in the y direction on the back panel 106 are formed so as to separate cells that neighbor each other in the x direction. In addition, auxiliary ribs 113 are arranged in stripes in the gaps between the ribs 112, so as to separate cells that neighbor each other in the y direction.

The structure of the ribs (first ribs) 112 is such that areas 112*a* that do not intersect with the auxiliary ribs 113 are relatively high, and areas 112*b* that intersect with the auxiliary ribs 113 are relatively low.

The rib areas 112*a* that are relatively high are provided so that their upper surfaces come into contact with a front panel 101 side of the PDP. Since the surface area of each rib area 112*a* is greater that the area of each rib area 112*b*, a sufficient amount of surface area can be ensured to contact the front panel 101 side.

The relatively low rib areas 112*b* are positioned between cells that neighbor each other in the y direction. This means that discharge spaces that correspond to rib area 112*b* are linked in the x direction between two cells that neighbor each other in the y direction.

Furthermore, rectangular second (auxiliary) ribs 113 (60 μm in height) are provided between neighboring rib areas 113. The auxiliary ribs 112*b* are of substantially the same height as the rib areas 112*b* (in other words, lower than the rib areas 112*a*). The ribs 112 and the auxiliary ribs 113 have respective widths of 80 μm and 150 μm.

According to the stated structure, the discharge space in each cell is surrounded by two neighboring ribs 112 and two neighboring auxiliary ribs 113. Here, the areas 112*b* of the ribs 112 and the auxiliary ribs 113 do not contact the front panel 101 side, but are provided so as to form a path that links neighboring rib 112 gaps and cell gaps that neighbor in the y direction. This means that all the discharge spaces on the panel are linked in the x and y directions.

Consequently, in a PDP having the back panel 106 that includes the ribs 112 and the auxiliary ribs 113, in the evacuation process evacuation is performed in not only in the y direction (in other words through the gaps between the ribs 112 and the front panel 101) as in a conventional PDP, but additionally in the x direction (in other words, through the gap between the ribs 112*b* and the front panel 101). This means that evacuation can be performed better than in a conventional PDP, and the amount residue in the PDP can be reduced. As a result, a PDP can be manufactured that has excellent image display when driven. If the PDP of the first embodiment is made to include an address electrode driver circuit for the address electrodes 108, a display electrode driver circuit for the display electrodes 103, and a control unit that controls these circuits, and is used as a PDP display apparatus, a PDP display apparatus can be provided whose evacuation characteristics and display performance are far superior to a conventional PDP display apparatus.

Conventional PDPs usually have a structure in which the top of each rib 112 contacts the front panel 101 side. This is to prevent charged particles that are generated in the cells during driving from moving to neighboring cells and causing crosstalk, and also to reinforce the frame of the PDP. However, in a rib pattern that includes ribs 112 and auxiliary ribs 113 such as in the first embodiment, the connecting parts of the ribs do not have a significant effect on cross talk during driving, therefore the height of the ribs 112 and the auxiliary ribs 113 can be adjusted appropriately at the connecting parts. The present invention focuses on this point, and is able to realize both improved luminosity and evacuation characteristics.

<Manufacturing Process of the PDP of the First Embodiment>

The following describes one example of a manufacturing method of the PDP of the first embodiment.

Note that the method described here is simply given as an example, and the PDP manufacturing method of the present invention is not limited to this example.

1. Manufacturing of the Front Panel

Display electrodes are formed on the surface of a front glass 102 which is 2.6 mm-thick soda-lime glass. Specifically, a plurality of stripe-shaped display electrodes 108 are formed by baking the front glass on which 5 μm-thick, 80 μm-wide lines of silver paste (NP-4028manufactured by Noritake is one example) has been printed.

Next, a conductive layer paste is screen printed on the front glass 102 so as to cover the display electrodes 103. The paste is lead that includes an organic binder (α-terapineol that includes 10% ethylcellulose), and is composed of 75% weight percentage of PbO, 15% weight percentage of $B_2O_3$, and 10% weight percentage of $SiO_2$. By drying and baking the front glass 102 on which the paste has been printed, a 20 μm-thick conductive layer 103 is formed on the glass 103.

A 0.5 μm-thick MgO film is formed on the conductive layer 103 as the protective film 105, by an electron beam evaporation method.

This completes the front panel 101.

2. Manufacturing of the Back Panel

A plurality of address electrodes are formed on the surface of the back glass 107 which is 2.6 mm-thick soda-lime glass.

Specifically, a plurality of stripe-shaped address electrodes are obtained by baking the front glass on which 5 μm-thick, 80 μm-wide lines of silver paste (NP-4028 manufactured by Noritake is one example) have been printed. Here, pairs of address electrodes are set with an interval of 0.4 mm or less therebetween in order to make the manufactured PDP, for example, a 40-inch class NTSC or VGA PDP.

Next, a 20 μm thick conductive film 109 is formed on the surface of the back glass 107 over the plurality of electrodes 108 by printing glass paste (NP-7973 manufactured by Noritake is one example) thereon, and baking the back glass 107 on which the paste has been printed.

After this, the ribs 112 and 113 that are characteristic of the first embodiment are formed on the conductive layer. Here, an example of applying screen printing with use of photosensitive resin paste is given.

FIG. 2 shows the process of forming the ribs successively.

Figure 2A:
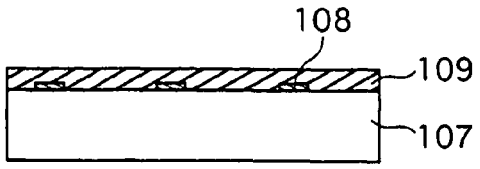
FIGS. 2A to 2G are schematic diagrams of a process for forming the ribs of the PDP in the first embodiment.
Figure 2B:
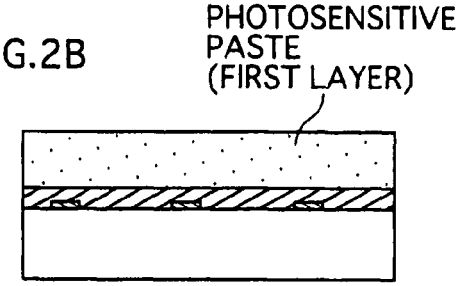

First, the pattern is formed on the conductive layer 109 using photosensitive barrier wall paste (photosensitive resin). Specifically, the photosensitive resin paste is printed using a screen plate so as to have a height of 130 μm, and then dried (FIG. 2B). Here, the width of the sections corresponding to the ribs 112 is set at 80 μm, and the width of the sections corresponding to the auxiliary ribs 113 is set at 150 μm.

Figure 2C:
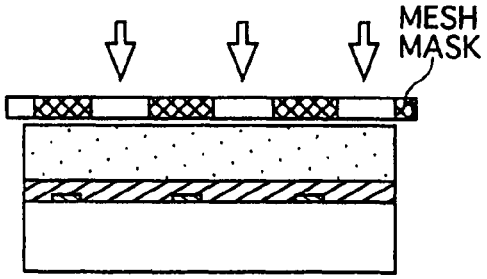
Figure 2D:
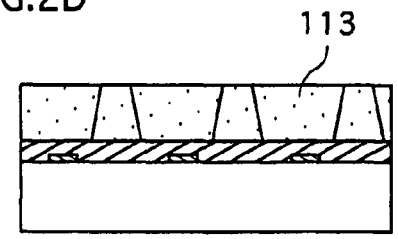
Figure 2E:
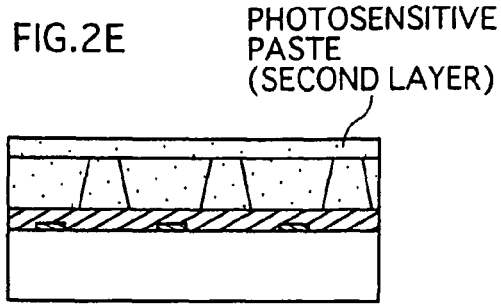

Next, the ribs 112*a* that are parallel with the address electrodes 108, and the ribs 112*b* that intersect with the address electrodes are all exposed and developed via a mesh-shaped mask, and the pattern formed (FIG. 2C). When this has been dried, portions that substantially correspond to the auxiliary ribs 113, and ribs 112 that are the same height as the auxiliary ribs 113 are formed (FIG. 2D).

Figure 2F:
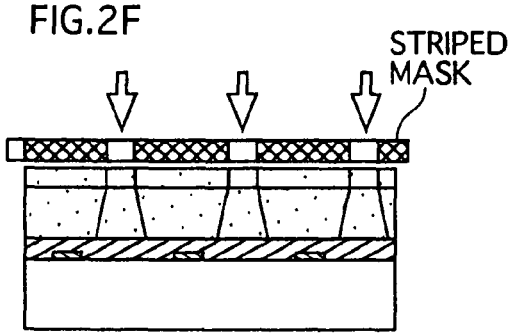
Figure 2G:
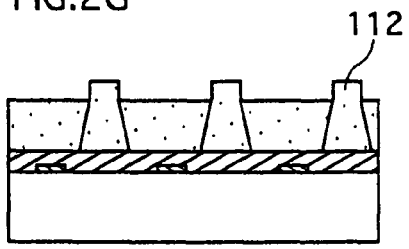

Next, a second layer of photosensitive resin paste is applied with use of a screen plate to the barrier walls that have been formed as described above. Specifically, the paste is printed so that the total height of the paste is 100 μm (i.e., the paste is layered on the paste of the process shown in FIG. 2B). Then, by using an intermittent stripe-pattern mask, parts of the paste that are parallel with the address electrodes 108 are exposed and developed (FIG. 2F). This is dried and baked, thus forming parts corresponding to the barrier walls 112*a* (FIG. 2G). At this point, projections and depressions are formed in accordance with the heights of the ribs 112*a*, 112*b* and 113.

During the baking, the paste that is the relatively high parts of the ribs 112 receives tensile stress from the parts of paste that are the relatively low ribs 112*a* and the ribs 113, causing the ends of the ribs 112*a* to connect smoothly with the ribs 112*b*. The projections and depressions are slightly rounded. The inventors determined that such formation of projections and depressions is favorable when the ribs 113 are wider than the ribs 112. Specifically, the fact that narrower ribs are pulled down by wider ribs during baking is used as a technique for forming favorable projections and depressions in the ribs.

By performing the process as described, 110 μm-high ribs 112 and 60 μm-high auxiliary ribs 113 are formed.

Note that one possible method for forming the ribs 112 and the auxiliary ribs 113 is to apply paste only once according to the heights of the ribs. However, in reality this method is not practical because it is very difficult to position the ribs.

When the ribs are formed, phosphor ink that includes either red (R) phosphor, green (G) phosphor or blue (B) phosphor is applied to barrier wall surfaces and exposed surfaces of the conductive film between barrier walls. This is dried and baked, to produce phosphor layers whose final thickness is approximately 15 μm.

The following is one example of the phosphor material generally used in PDPs.

red phosphor: $(Y_xGd_{1-x})BO_3$: $EU^{3+}$ green phosphor: $Zn_2SiO_4$:$Mn^{3+}$ blue phosphor: $BaMgAl_{10}O_{17}$:$Eu^{3+}$ (or $BaMgAl_{14}O_{28}$:$Eu^{3+}$)

The phosphor material is a powder whose average grain diameter is, for example, approximately 3 μm. Various methods may be used to apply the phosphor ink, and here a commonly known method called the meniscus method is used. The meniscus method involves discharging phosphor ink from very fine nozzles while forming a meniscus (a bridge caused by surface tension). This method is well suited to applying phosphor ink evenly on the appropriate areas. Note that the method used in the present invention is, of course, not limited to being the meniscus method, but may be another method such as a screen printing method.

This completes the back panel.

Note that soda-lime is given as an example of the material from which the front and back panels are made, but another material may be used instead.

3. Sealing and Discharge Gas Insertion Process

Sealing glass is applied to the periphery of the formed back panel 106 and the front panel 101 which are then placed together and heated to form a panel, and gas is inserted in the panel.

Next, the inside of the panel (discharge space 115) is decompression evacuated to $1*10^{-}4$ Pa.

When decompression evacuating, a large amount of gas can be evacuated at once from the x and y directions by making use of the gaps between the ribs areas 112*b* that are relatively low and the front panel 101, in addition to the gaps between ribs 112. This means that evacuation characteristics can be improved significantly compared to a conventional PDP, because residue inside the panel is removed smoothly in a short amount of time through the gaps together with the evacuation. As a result, the panel can be evacuated favorably with little residue being left in the panel.

Next, an Ne—Xe discharge gas (mixed gas of 95% weight percentage of Neon and 5% weight percentage of Xenon) is inserted into the panel so as to be 66.5 kPa. This completes the PDP 114.

TESTS ON IMPLEMENTATION EXAMPLES

Tests were performed regarding performance of the above-described PDP of the first embodiment (implementation example 1). Other PDPs, specifically an implementation example 2 and comparison examples 1 and 2 which are described below, were also manufactured and subject to the same tests.

Implementation Example 2

A sandblast method was used to form ribs 112 and ribs 113 so as to manufacture a PDP the same as that in the first embodiment. This PDP is implementation example 2.

Comparison Example 1

A PDP having conventional-type ribs (see FIG. 7) was manufactured. The ribs were formed using the photoresist method described in the above-described embodiment.

Comparison Example 2

A PDP having ribs 112 and auxiliary ribs 113 was manufactured. Here, the ribs 112 and the ribs 113 have the same height of 80 μm. Other dimensions of this PDP were substantially the same as that in the first embodiment.

The implementation examples 1 and 2 and the comparison examples 1 and 2 were driven by identical driver devices. Table 1 shows measured values expressing the performance of the PDP.

TABLE 1

| | RIB CHARACTERISTICS | EVACUATION TIME*[1] | LUMINANCE | COLOR TEMPERATURE | IMAGE QUALITY (FLICKERING) |
|---|---|---|---|---|---|
| IMPLEMENTATION EG. 1 | SEPARATE RIBS | 1 MIN 40 SECS | 350 cd/m$^2$ | 9200 K | NO FLICKERING |
| IMPLEMENTATION EG. 2 | SANDBLAST METHOD | 1 MIN 50 SECS | 340 cd/m$^2$ | 9100 K | NO FLICKERING |
| COMPARISON EG. 1 | CONVENTIONAL EXAMPLE (STRIPE-TYPE RIBS) | 1 MIN 20 SECS | 270 cd/m$^2$ | 8600 K | NO FLICKERING |
| COMPARISON EG. 2 | SEPARATE RIBS (NO HEIGHT DIFFERENCE) | 4 MINS 50 SECS | 360 cd/m$^2$ | 8000 K | MUCH FLICKERING |

*[1]time required for gas in the panel to reach 1 * $10^{-4}$ Pa

As is clear from the measured values shown in Table 1 for the implementation examples 1 and 2, more favorable results are obtained for performance in terms of evacuation time, luminance, color temperature and image quality (flickering) when ribs 112 and auxiliary ribs 113 formed by either the photo resist method or the sandblast method, compared to the comparison examples. This shows that any method may be used to manufacture the ribs 112 and auxiliary ribs 113 of the present invention. However, the photo resist method and the sandblast method are generally the most convenient methods.

Furthermore, although the comparison example 1 has a slightly faster evacuation time than the implementation examples 1 and 2, the implementation examples 1 and 2 are superior in terms of the balance between evacuation time, luminosity and color temperature.

In addition, the evacuation time for the comparison example 2 is approximately three times that of the other PDPs. This is thought to because the ribs 112 and the auxiliary ribs 113 in the comparison example 2 are the same height, meaning that they lie flat on the front panel, without gaps, thereby making evacuation of the discharge space very difficult.

<Other Points>

Figure 3:
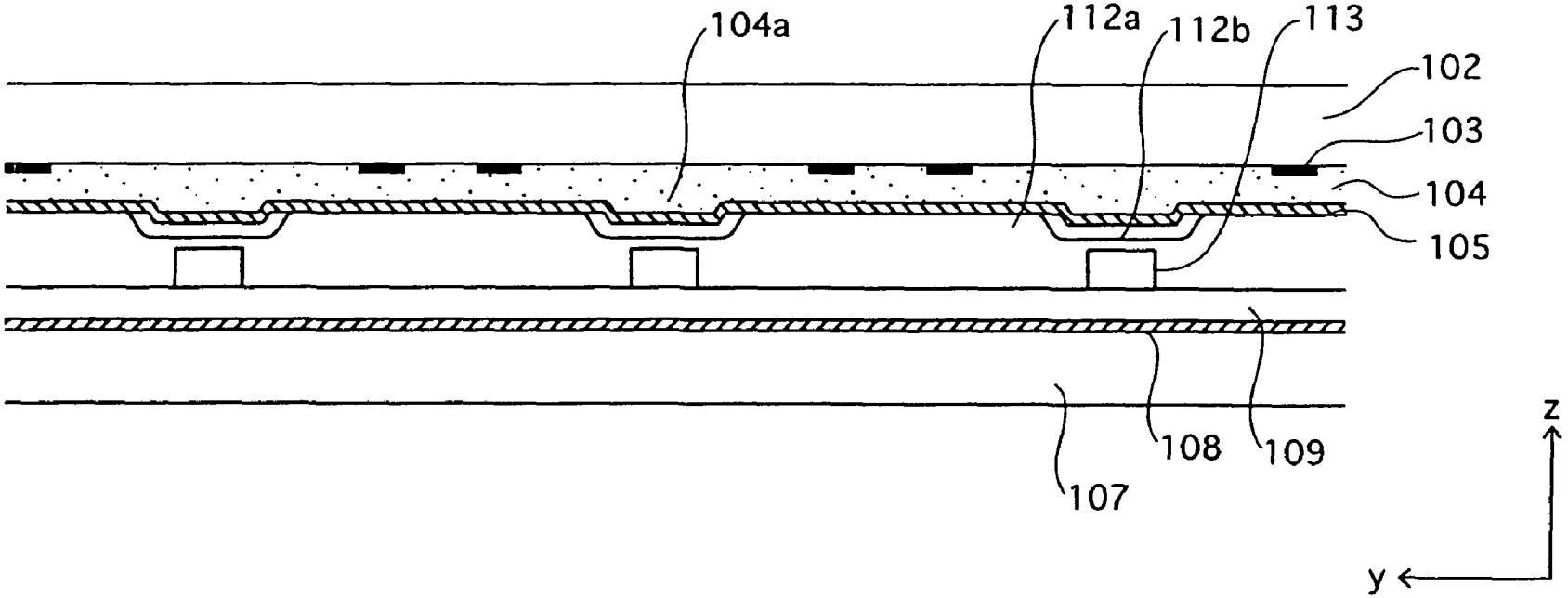
FIG. 3 is a cross sectional diagram (variation) of the PDP in the first embodiment.

The surface of the front panel 101 that opposes the ribs 112 and the auxiliary ribs 113 is not limited to being flat as described in the first embodiment. Instead, the front panel 101 in the present invention may have protrusions in positions that correspond to the relatively low ribs 112*b* and auxiliary ribs 113. Here, FIG. 3 shows an example of protrusions 104*a* formed by having the conductive layer 104 protrude in a stripe pattern corresponding to the ribs 112*b* and the auxiliary ribs 113. The protrusions 104*a* and the ribs 112 are not completely joined; a space is provided therebetween so that evacuation can be performed quickly in the evacuation process.

According to such a construction, in addition to the effects of the first embodiment, the discharge space is each cell is well sealed. Consequently, when discharge is performed during driving and charged grains such as priming grains occur in the cells, the grains are sustained for a long time in the discharge space, making it possible to take advantage of continuous discharge. This means that, compared to a conventional PDP, illumination efficiency is improved, and power consumption and voltage are reduced.

Furthermore, by forming the protrusions 104*a* in stripes, spatial separations between neighboring cells are made in the y direction, thus obtaining an effect of suppressing crosstalk between cells. Consequently, by applying the stripe-shaped protrusions 104*a* to a high-definition cell structure such as high vision, a PDP with favorable display performance can be obtained.

Note that these stripe-shaped protrusions 104*a* can be obtained, for example, by screen printing conductive glass paste on parts of the conductive layer 104 that has already been formed flat, and baking.

Structure of the Second Embodiment

Figure 4:
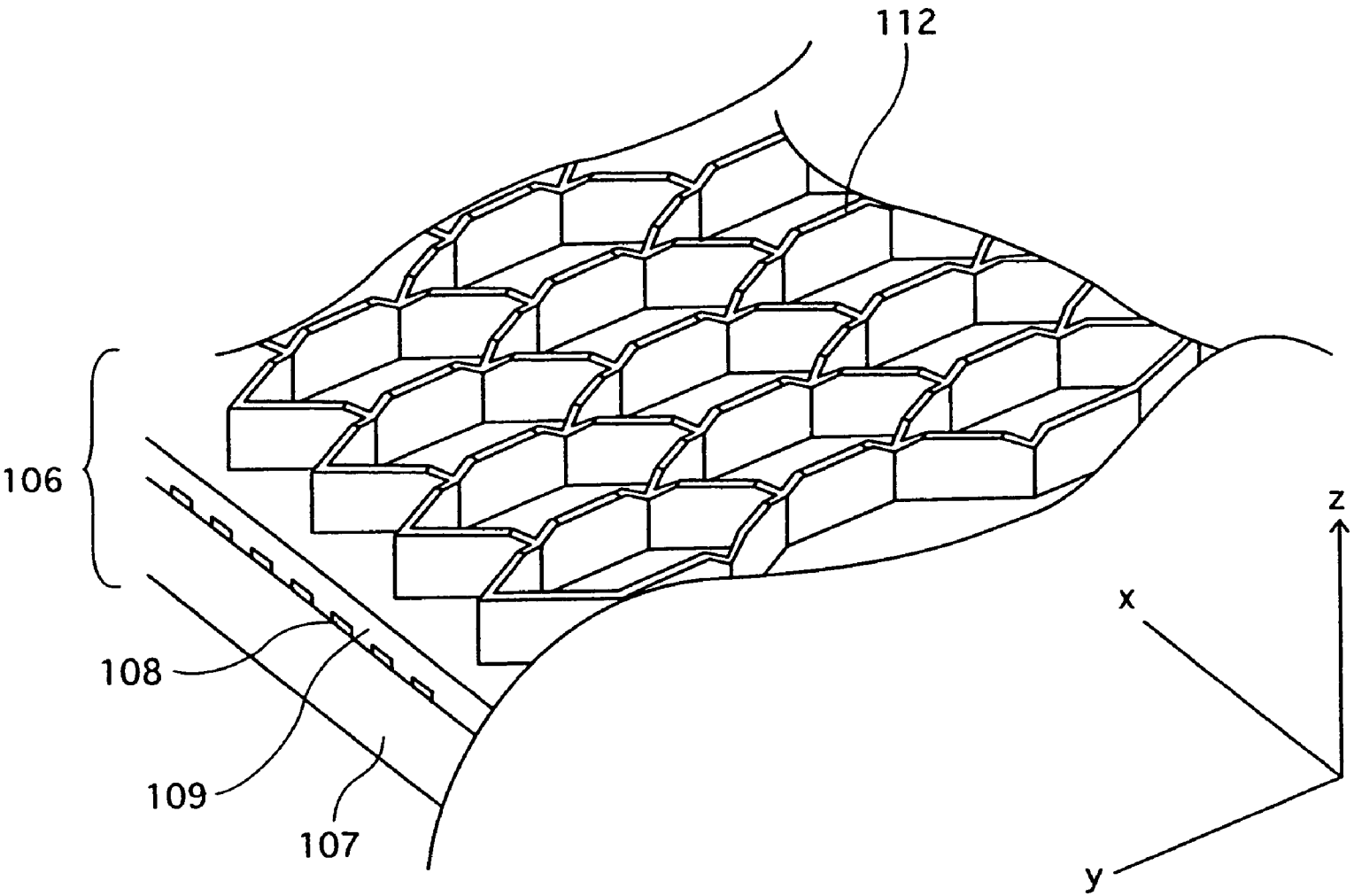
FIG. 4 is a perspective diagram of the back panel of a PDP in a second embodiment.
Figure 5:
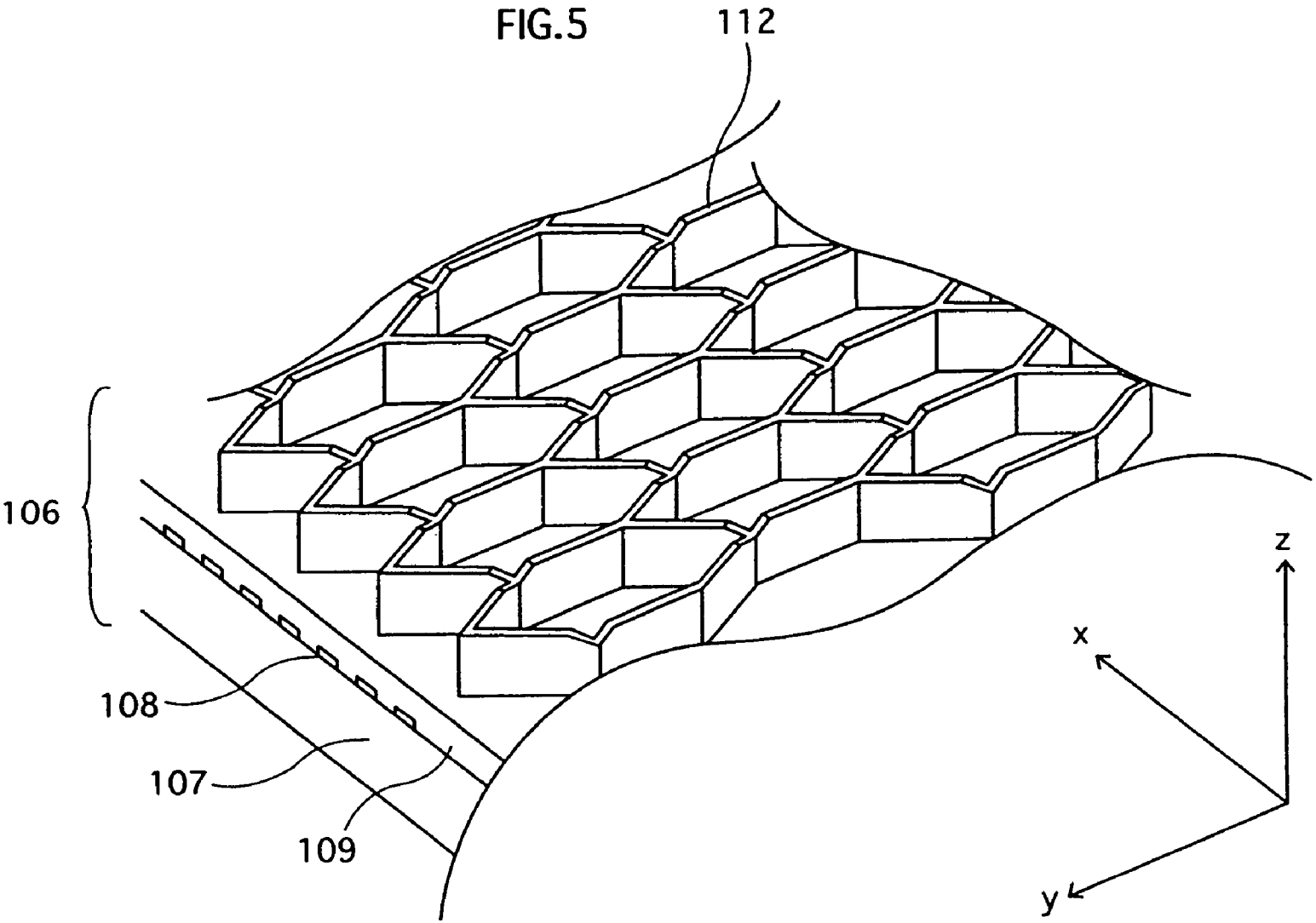
FIG. 5 is perspective diagram (variation) of the back panel of the PDP in the second embodiment.

FIG. 4 is a perspective diagram of the back panel of a PDP in the second embodiment.

As the diagram shows, the second embodiment is characterized by a structure in which the ribs 112 are formed in a hexagonal honeycomb shape, and the discharge space in each hexagon is linked to other discharge spaces by cutting out corners of hexagons at the tops that oppose the front panel 101. As one example of the sizes of parts of the PDP of the second embodiment, the height of the ribs 112 is 110 μm, the height of the cutout portions is 60 μm, and the thickness of the phosphor is 15 μm. The cell size is 0.54 mm (x direction) by 1.44 mm (y direction).

Note that these dimensions are simply examples, and the present invention is not limited to these dimensions.

Figure 7:
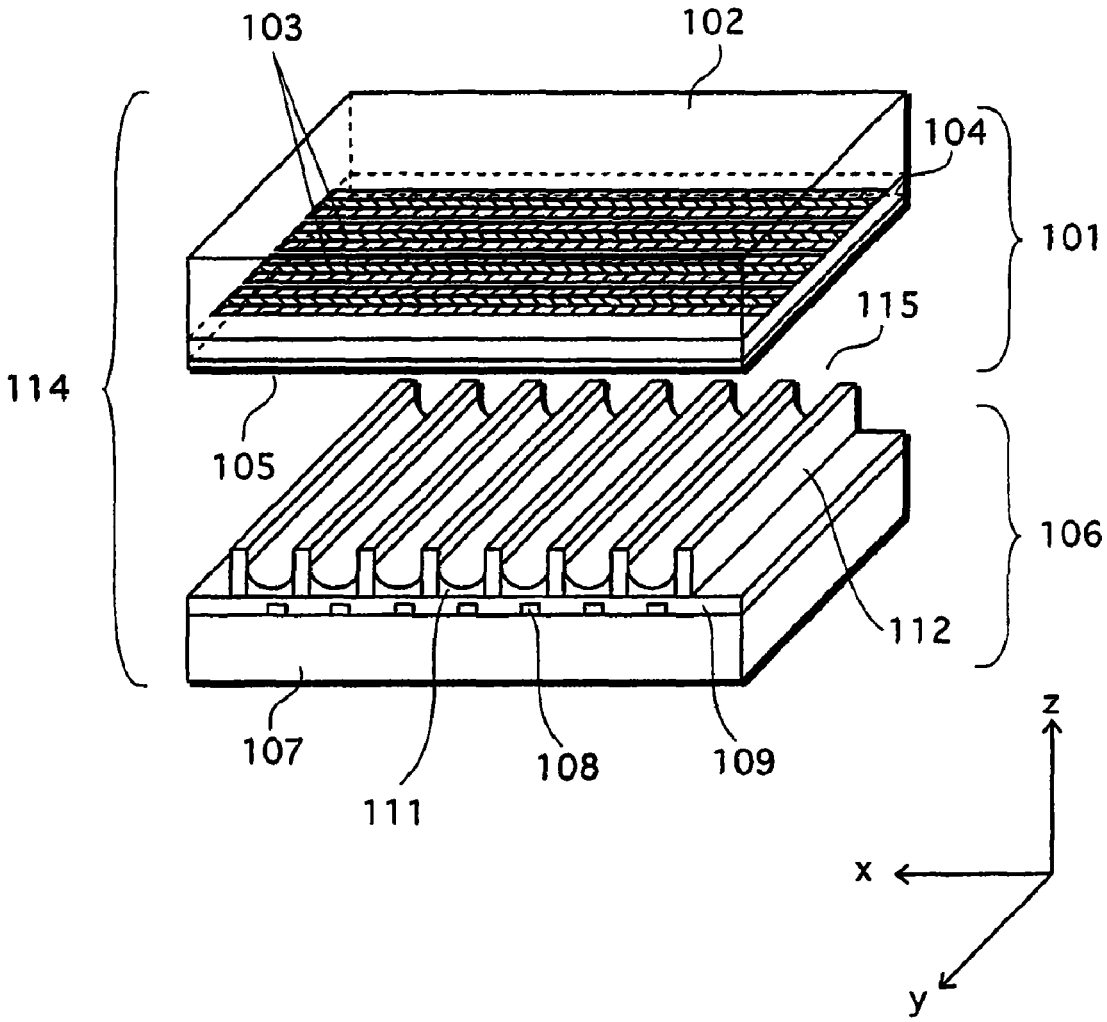
FIG.7 PRIOR ART
FIG. 7 is a perspective diagram showing the structure of a conventional PDP.
Figure 8:
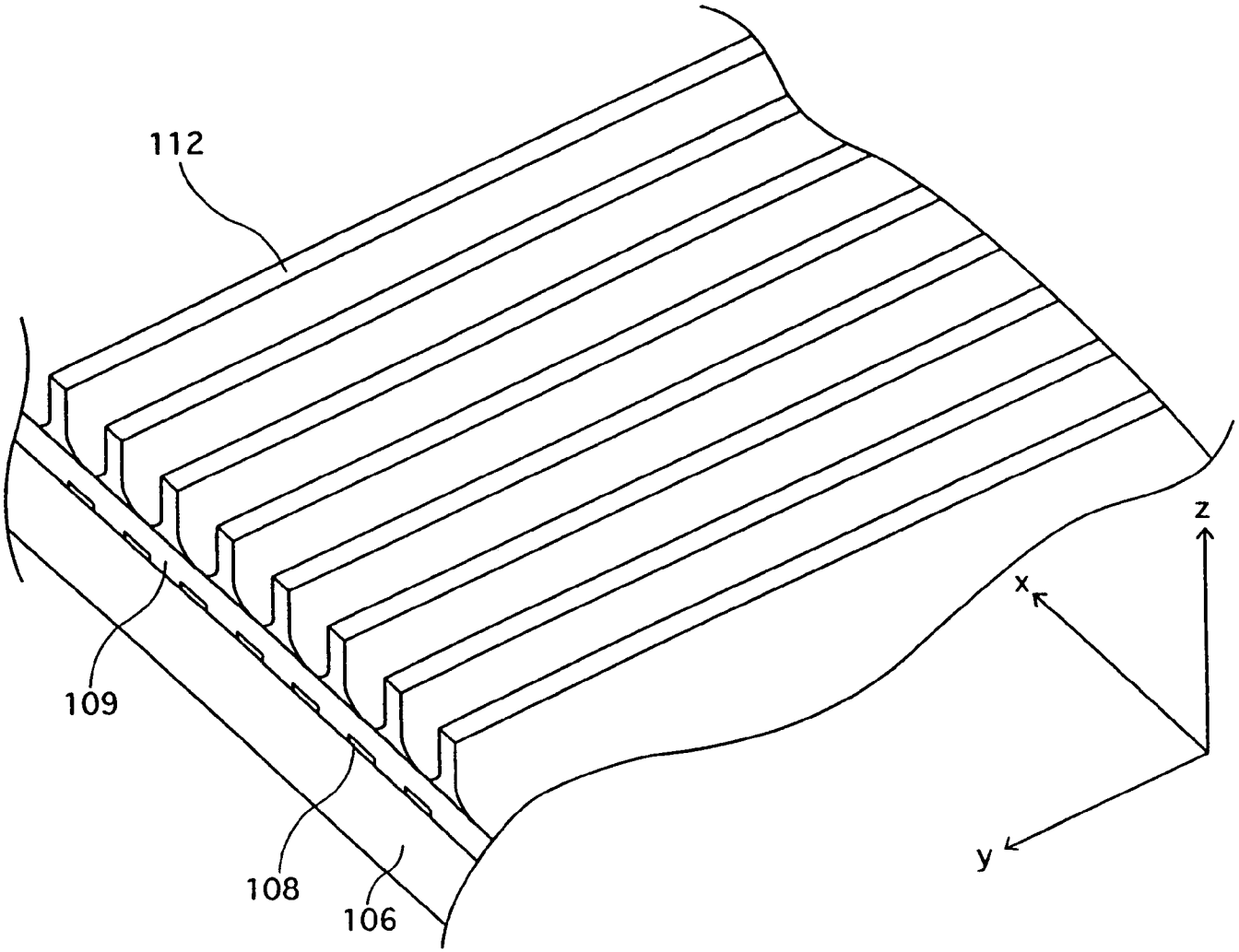
FIG.8 PRIOR ART
FIG. 8 is a schematic diagram of ribs of a conventional PDP.
Figure 9:
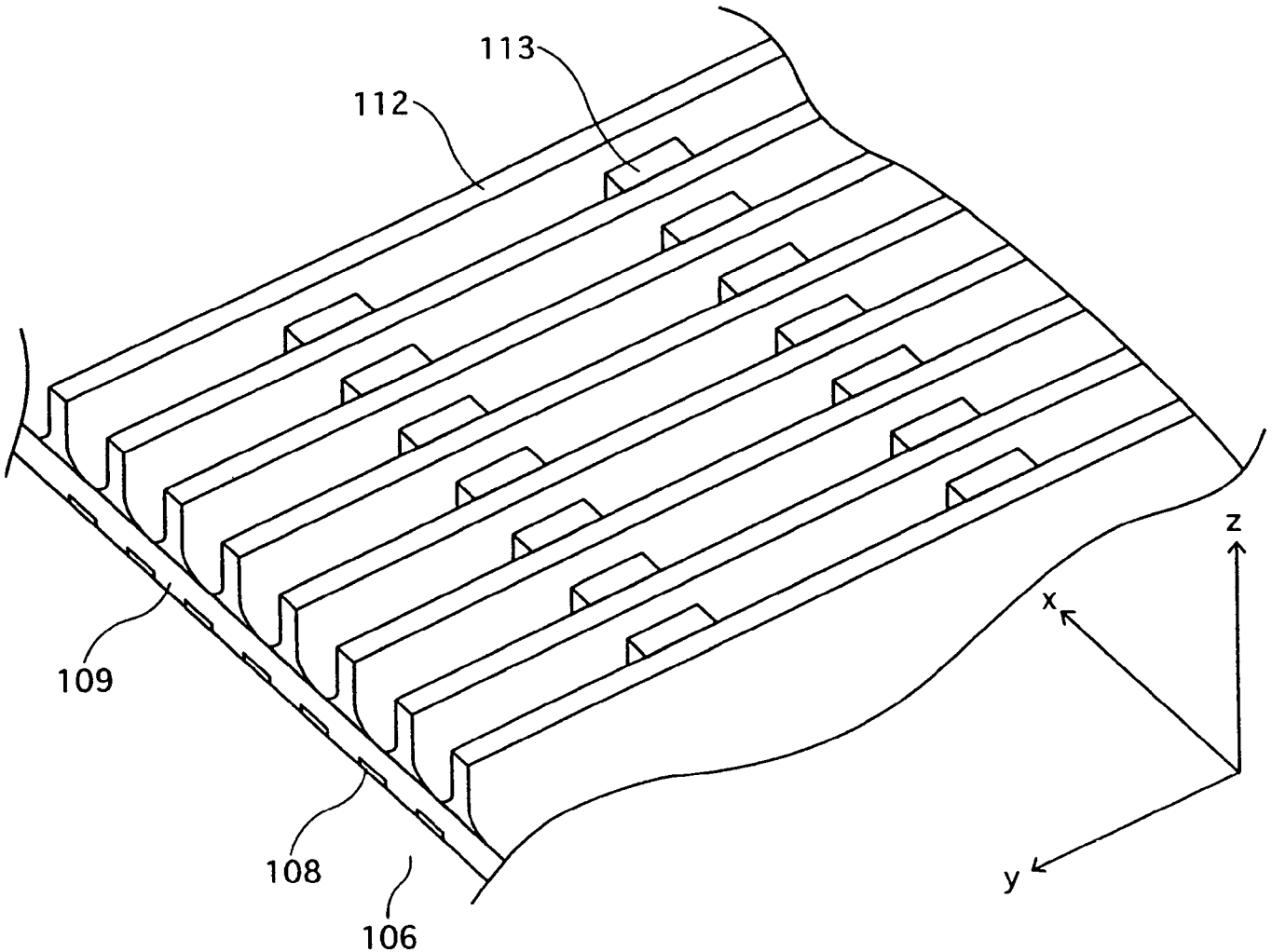
FIG.9 PRIOR ART
FIG. 9 is a schematic diagram of ribs of a conventional PDP.

The ribs of such a honeycomb pattern have a greater surface area than the conventional PDP shown in FIG. 7 that has stripe-shaped ribs. Therefore, more phosphor can be applied to the surface of honeycomb ribs, consequently improving luminance. Furthermore, by separating cells with hexagonal honeycomb-type ribs, the PDP has higher definition.

Furthermore, in addition to the above-describe effects, each discharge space enclosed by the honeycomb-shaped ribs is linked to neighboring discharge spaces in several places. Therefore, the evacuation process during manufacturing can be performed very smoothly, and a favorable PDP in which very little residue remains can be manufactured.

<Manufacturing Method for the PDP of the Second Embodiment>

The method for manufacturing the PDP of the second embodiment overall is substantially the same as that for the PDP of the first embodiment, therefore a method for forming the honeycomb-type ribs 112 (using the sandblast method as one example) is described here. Note that the ribs 112 in the present invention may, of course, be formed using another method.

First, material that includes glass paste with which the ribs are formed is screen printed on the conductive film 109 of the back panel 106, and then dried. This is repeated until a predetermined thickness is achieved.

Next, a photo-resistant film is laminated on the dried back panel 106, and is exposed and developed in the pattern of the honeycomb-shaped ribs. Here, the thickness of parts of the photo-resistant film that do not correspond to the corners of the honeycomb-shape are set to be thicker than the parts that correspond to the corners. This means that the top of the material that forms the ribs is protected by the resistant film.

Next, sandblast processing that uses silica grains is applied on the photo-resistant layer, to form the pattern of the ribs 112. The parts that are cut out from the corners of the honeycomb-shape are shaved deeply so as to have a different blast rate to the other parts, thus forming a desired shape. By baking this, the honeycomb-shaped ribs 112 shown in FIG. 4 are complete.

TESTS OF IMPLEMENTATION EXAMPLES

Tests were performed regarding performance of the PDP of the second embodiment as an implementation example 3. The same tests were performed on an implementation example 4 of a PDP manufactured as described below.

Implementation Example 4

Honeycomb-shaped ribs were formed similarly to those in the second embodiment, however, the number of cut-out portions was half that of the second embodiment.

When the PDPs of the second and fourth embodiment implementation examples were made to display using the same operation circuit, the results were as shown in Table 2.

As is clear from Table 2, whether the number of cut outs in each hexagon is six or three, good performance is obtained in terms of both evacuation characteristics and luminance compared to the comparison example 1. In particular, luminance is dramatically improved compared to the implementation examples 1 and 2. Superior display characteristics are attained by separating cells by hexagonal honeycomb-shaped ribs 112.

<Other Points>

Examples are shown in the first and second embodiments of forming the ribs 112 and 113 using a photo-resist method or a sandblast method. The present invention is not, however, limited to using such methods; the same effects may be obtained by forming the ribs 112 and 113 using a method such as a printing method or a lift off method. However, the sandblast method is preferable since it enables the ribs to be formed quickly and simply.

Note that the sizes of the ribs and the like are not limited to those described in the first and second embodiments, but may be adapted according to panel specifications and the like.

Figure 6:
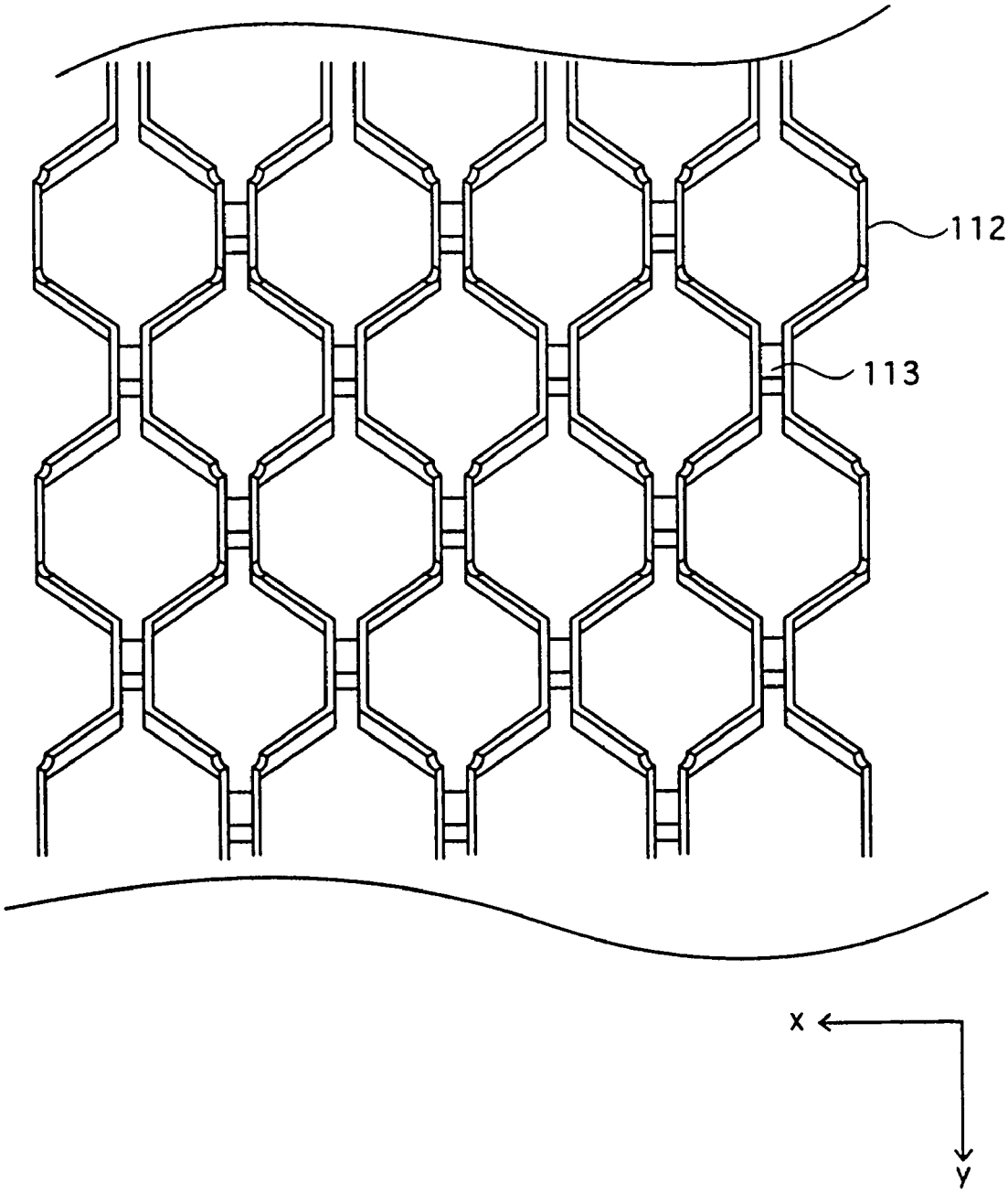
FIG. 6 is perspective diagram (variation) of the back panel of the PDP of the present invention.

Furthermore, the structure of the ribs in the present invention is not limited to those described in the first and second embodiments. Instead, for example, the ribs 112 may have a trapezoidal-stripe shape where two neighboring ribs 112 are symmetrical in a widthwise direction, and auxiliary ribs 113 are provided in the stripe shaped area, as the perspective view of a front panel in FIG. 6 shows. In this case, portions may be cut away from the corners of the ribs 112 in order to improve linkage of discharge spaces between neighboring ribs. This structure enables the effects of both the first and second embodiments to be obtained.

Furthermore, it is preferable to connect the PDP of the second embodiment to a display apparatus that includes a display electrode driving circuit for discharge sustain to the display electrode 103, an address electrode driving circuit for selecting pixels in the address electrodes 108, and a controller that controls supply of image information to the pixels, to make the PDP a PDP display apparatus. Such an PDP display apparatus, compared to a conventional PDP, provides an image display apparatus that has stable image display without flickering, because of the significant reduction in residual inside the panel.

INDUSTRIAL APPLICABILITY

The present invention can be applied to televisions, and in particular high-vision televisions that are capable of high-definition image reproduction.

TABLE 2

| | RIB CHARACTERISTICS | EVACUATION TIME*[1] | LUMINANCE | COLOR TEMPERATURE | IMAGE QUALITY (FLICKERING) |
|---|---|---|---|---|---|
| IMPLEMENTATION EG. 3 | HONEYCOMB-TYPE RIBS 1 | 1 MIN 40 SECS | 480 cd/m$^2$ | 9200 K | NO FLICKERING |
| IMPLEMENTATION EG. 4 | HONEYCOMB-TYPE RIBS 2 | 2 MINS | 450 cd/m$^2$ | 8600 K | NO FLICKERING |
| COMPARISON EG. 1 | CONVENTIONAL EXAMPLE (STRIPE-TYPE RIBS) | 1 MIN 20 SECS | 270 cd/m$^2$ | 8600 K | NO FLICKERING |

*[1]time required for gas in the panel to reach $1 * 10^{-4}$ Pa

The invention claimed is:

1. A plasma display panel that includes a first substrate that has a plurality of first ribs and second ribs formed on a surface thereof, and a second substrate that opposes the first substrate via the ribs so as to form an internal space, the first ribs and the second ribs separating a plurality of cells from each other at areas other than at least one intersection between adjacent cells and a height in a panel thickness direction of the first ribs and the second ribs at a position of the at least one intersection is less than the height of the first ribs and second ribs at areas other than the at least one intersection, and the first ribs and second ribs are structured such that tops thereof in areas other than the at least one intersection touch the second substrate.

2. The plasma display panel of claim 1, wherein at least the first ribs or the second ribs are provided in a stripe pattern.

3. The plasma display panel of claim 1, wherein the first and second ribs are arranged so as to form hexagonal honeycomb shapes that separate the plurality of cells from each other, and at least three intersections of the first and second ribs that form any given hexagonal honeycomb shaped cell, a height of the first and second ribs in the panel thickness direction is less than a height of the first and second ribs at places other then at the at least three intersections.

4. The plasma display panel of claim 3, wherein at six intersections of the first and second ribs that form the hexagonal honeycomb shaped cell, a height of the first and second ribs in the panel thickness direction is less than a height of the first and second ribs at areas other than the six intersections.

5. The plasma display panel of claim 3, wherein the intersections having less height are located such that an evacuation is formed across neighboring cells, the evacuation path in the hexagonal honeycomb shaped cell being shorter in length than the hexagonal honeycomb shaped cell.

6. The plasma display panel of claim 1, wherein a thickness of the first ribs is greater than a thickness of the second ribs.

7. The plasma display panel of claim 1, wherein pairs of neighboring ribs meander along a plane of the first substrate so as to form symmetrical trapezoid-shapes around each cell.

8. The plasma display panel of claim 1, wherein the second substrate has, on a surface thereof that faces the first substrate, protrusions in a stripe formation and that fit into the intersections such that a space is formed between a top of each protrusion and the corresponding intersection.

9. A plasma display panel display apparatus, comprising:

the plasma display panel of claim 1 further including a plurality of address electrodes on the surface of the first substrate, and a plurality of display electrodes on the surface of the second substrate, the address electrodes and the display electrodes being provided in opposition so as to intersect with each other;

an address electrode driving circuit operable to drive the electrodes;

a display electrode driving circuit operable to drive the display electrodes; and a controller operable to control both the circuits.

* * * * *